US005775989A

United States Patent [19]

Choi

[11] Patent Number: 5,775,989

[45] Date of Patent: Jul. 7, 1998

[54] METHODS OF AND APPARATUS FOR ADJUSTING AIR FLOW CONTROL LOUVER

[75] Inventor: Kwi-Ju Choi, Suwon, Rep. of Korea

[73] Assignee: Samsung Electronics Co., Ltd., Suwon, Rep. of Korea

[21] Appl. No.: 698,655

[22] Filed: Aug. 16, 1996

[30] Foreign Application Priority Data

Aug. 21, 1995 [KR] Rep. of Korea ..... 95-25768
Sep. 27, 1995 [KR] Rep. of Korea ..... 95-32152

[51] Int. Cl.[6] ..... F24F 13/14

[52] U.S. Cl. ..... 454/285; 454/256

[58] Field of Search ..... 454/125, 256, 454/258, 285, 313, 315, 319, 320, 321

[56] References Cited

FOREIGN PATENT DOCUMENTS

| | | | |
|---|---|---|---|
| 60-16257 | 1/1985 | Japan | 454/285 |
| 61-17845 | 1/1986 | Japan | 454/258 |
| 62-147257 | 7/1987 | Japan | 454/285 |

*Primary Examiner*—Harold Joyce
*Attorney, Agent, or Firm*—Burns, Doane, Swecker & Mathis, L.L.P.

[57] ABSTRACT

A room air conditioner includes a body having an air inlet, an air outlet, a heat exchanger, and a fan. The fan draws-in air from the room and directs the air through the heat exchanger (to be selectively heated or cooled therein) before returning the air to the room. At the air outlet a louver is provided for directing the flow of air being returned to the room. A motor is connected to the louver for vertically oscillating the louver so that the air can be returned sequentially to upper and lower portions of the room. The speed of movement of the louver is constantly varied, the pattern of variance being dependent upon whether heated or cooled air is being discharged, in order to achieve a more uniform room temperature, by taking advantage of the fact that hot air in a room tends to rise. If cooled air is being discharged, the louver travels faster at its lower range of movement so that more cooled air is discharged into an upper portion of the room. If heated air is being discharged, the louver travels faster at its upper range of movement so that more heated air is discharged into a lower portion of the room.

8 Claims, 8 Drawing Sheets

METHODS OF AND APPARATUS FOR ADJUSTING AIR FLOW CONTROL LOUVER

BACKGROUND OF THE INVENTION

1. Field of the Invention

The present invention relates to a method and an apparatus for adjusting an air flow (wind) direction control louver of an air conditioner.

2. Description of the Prior Art

Generally, air conditioners include a heating device for heating a cold air present in a room and supplying the heated air into the room again, and a cooling device for cooling a warm room air and supplying the cooled air into the room again. There has been also known an air conditioner having both the heating function and the cooling function.

Recently, these air conditioners also have had a cleaning function for cleaning a contaminated room air and supplying the cleaned air into the room again.

Referring to FIG. 1, there is illustrated an indoor unit of a conventional air conditioner (generally called "aircon") having a cooling function and a heating function. Of course, the air conditioner also includes an outdoor unit not shown.

In FIG. 1, the reference numeral 1 denotes a indoor unit body. An air inlet 3 is formed at the upper side of the body 1, thereby introducing an air present in a room into the interior of the indoor unit.

An air outlet 5 is formed at the lower side of the body 1, thereby supplying the air cooled by a heat exchanger equipped in the indoor unit into the room again.

The heat exchanger will be described hereinafter, in conjunction with FIG. 2.

On the other hand, at the right side of the air outlet 5 a key input unit 26 is provided, for inputting an operation mode (automatic, cooling, dehumidifying, heating, ventilation and the like), an operation start signal and an operation stop signal of the air conditioner.

The key input unit 26 is, further, adapted to adjust the amount of wind and the wind direction of air being discharged through the air outlet 5.

The reference numeral 7 denotes a horizontally-extending louver for controlling the direction of the air supplied into the room through the air outlet 5.

The louver 7 is attached to an axis of a stepping motor which is operated according to pulse signals having a predetermined frequency generated from control means not shown. Therefore, an operation of the louver 7 depends on the stepping motor.

FIG. 2 is an elevational view in section illustrating the air conditioner of FIG. 1. In FIG. 2, the reference numeral 9 denotes the heat exchanger. When the room air introduced into the interior of the indoor unit passes through the heat exchanger 9, it comes into contact with heat exchanging fins of the heat exchanger 9, which are kept at a low temperature by a cold refrigerant flowing in the interior of the heat exchanger 9, and thereby achieves a heat exchange with the refrigerant.

The reference numeral 11 denotes a fan which discharges the air cooled in the heat exchanger 9, into the room through the air outlet 5.

At the interior of the body 1, a wall 13 is provided which forms a duct to guide air flow to the air outlet 5.

In the air conditioner having the above-mentioned structure, when the user pushes down the key input unit 26 or a remote controller, thereby selecting an operation mode, the air conditioner initiates its operation.

That is, air present in the room is introduced into the interior of the body 1 through the air inlet 3 according to a driving of the fan 11 and then heat-exchanged with the heat exchanger 9, so that it may be cooled. The cooled air is then continuously discharged into the room again through the air outlet 5.

At this time, the control unit also sends an appropriate motor drive signal to a stepping motor driving unit to drive the stepping motor. The motor drive signal is a pulse signal having a predetermined frequency for actuating the stepping motor. The stepping motor is rotated by the pulse signal outputted from the control unit. By the driving of the stepping motor, the louver 7 is driven in the vertical direction.

The control unit determines whether or not the louvers 7 are completely driven to an upper limit position.

As a result, when the louver 7 is completely driven to the upper limit position, the control unit sends a control signal for changing the drive direction of the louver 7, to the stepping motor driving unit.

Therefore, in accordance with the control signal from the control unit the louver 7 is driven to the lower limit position.

According to the driving of the louver 7 the discharging direction of air which is heat-exchanged with the heat exchanger 9, thereby to be cooled, is adjusted.

In the above-mentioned conventional construction, however, the louver 7 is driven in the vertical direction at a constant speed in the cooling mode and also in the heating mode. Therefore, the cooled air discharged to the room through the air outlet 5 is constant since the staying time of the louver 7 at the positions A, B and C is all the same, thereby causing temperature in the room not to be uniform since cool air sinks and warm air rises. That is, the upper portion of the room will be too warm in summer (i.e., during a cooling mode of operation) and the lower portion of the room will be too cool in winter (i.e., during a heating mode of operation).

SUMMARY OF THE INVENTION

Therefore, an object of the invention is to solve the above-mentioned problems encountered in the prior art and, thus, to provide a method and an apparatus for adjusting an air flow control louver, capable of maintaining a uniform temperature in a room by changing the driving speed of the louver according to whether a cooling mode or heating mode is performed.

In order to accomplish the object the present invention provides in an air conditioner including an air inlet for introducing air from a room into a body, a heat exchanger for heat-exchanging the air, an air outlet for discharging the heat-exchanged air, a wind direction louver for controlling a discharging direction of the heat-exchanged air, and an apparatus for adjusting air flow control louver comprising:

drive selection means for selecting a cooling mode or a heating mode to drive the louver;

control means for controlling the driving speed of the louver in the vertical direction according to the cooling mode or the heating mode, and for controlling an overall operation of the air conditioner; and motor driving means for driving a motor to drive the louver in accordance with a control signal generated from the control means.

Furthermore, in order to accomplish the object the present invention provides a method of adjusting an air flow control louver comprising the steps of:

A) driving the louver to an initial point for performing an air conditioning operation;

B) determining an operation mode selected by user;

C) driving the louver in a predetermined direction to uniformly distribute air into a room through an air outlet according to the operation mode;

D) determining the present position of the louver being driven in the predetermined direction; and E) changing the driving speed of the louver according to the present position of the louver.

BRIEF DESCRIPTION OF THE DRAWINGS

Other objects and aspects of the invention will become apparent from the following description of embodiments with reference to the accompanying drawings in which.

DETAILED DESCRIPTION OF A PREFERRED EMBODIMENT OF THE INVENTION

Figure 1:
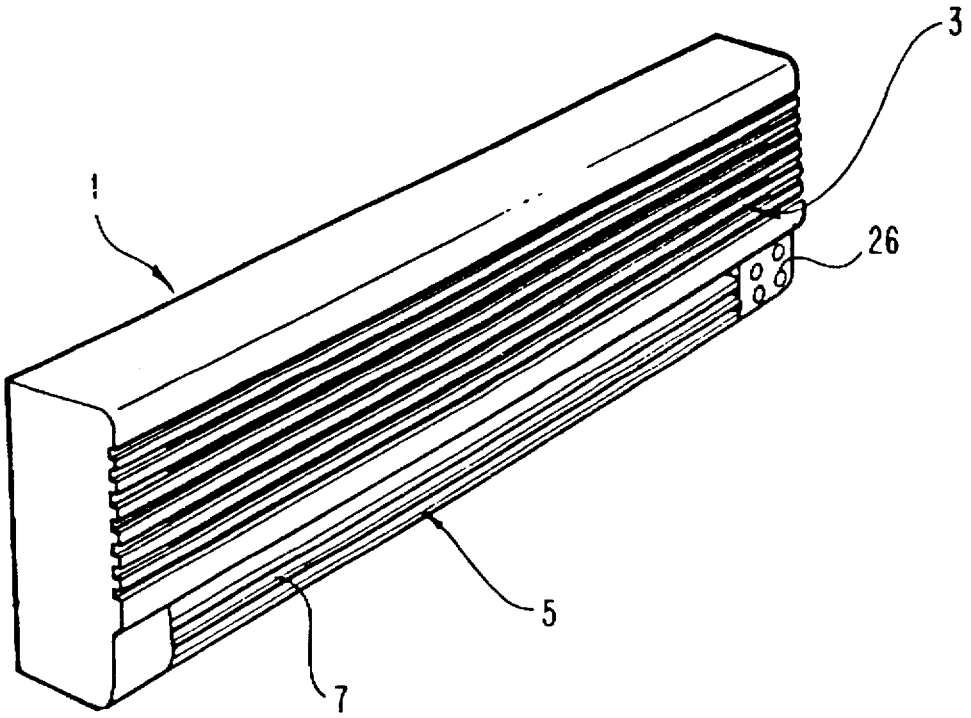
FIG. 1 (PRIOR ART)
FIG. 1 is a perspective view illustrating an indoor unit of a conventional air conditioner.
Figure 2:
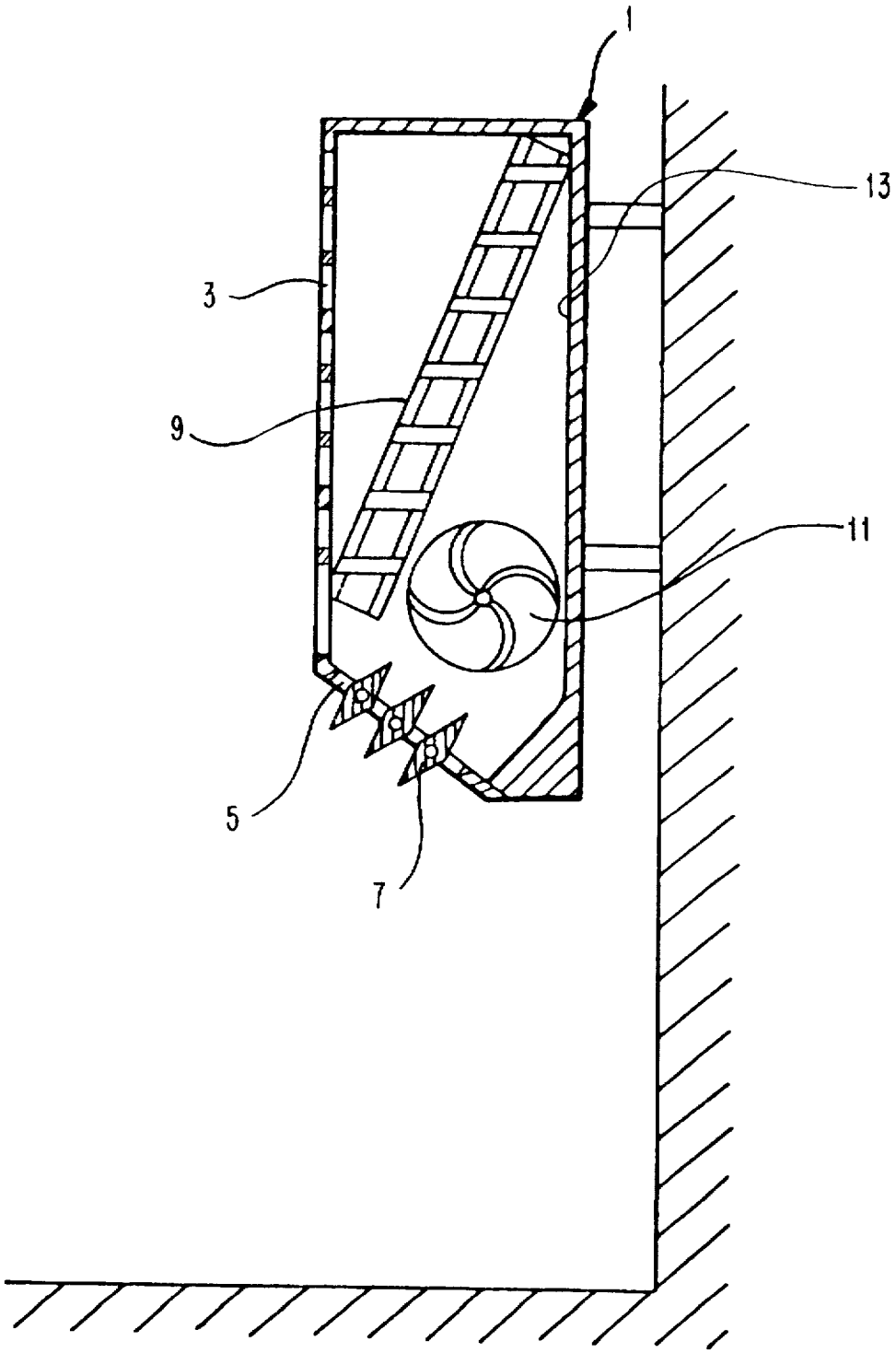
FIG. 2 (PRIOR ART)
FIG. 2 is an elevational view in section illustrating the air conditioner of FIG. 1.
Figure 3:
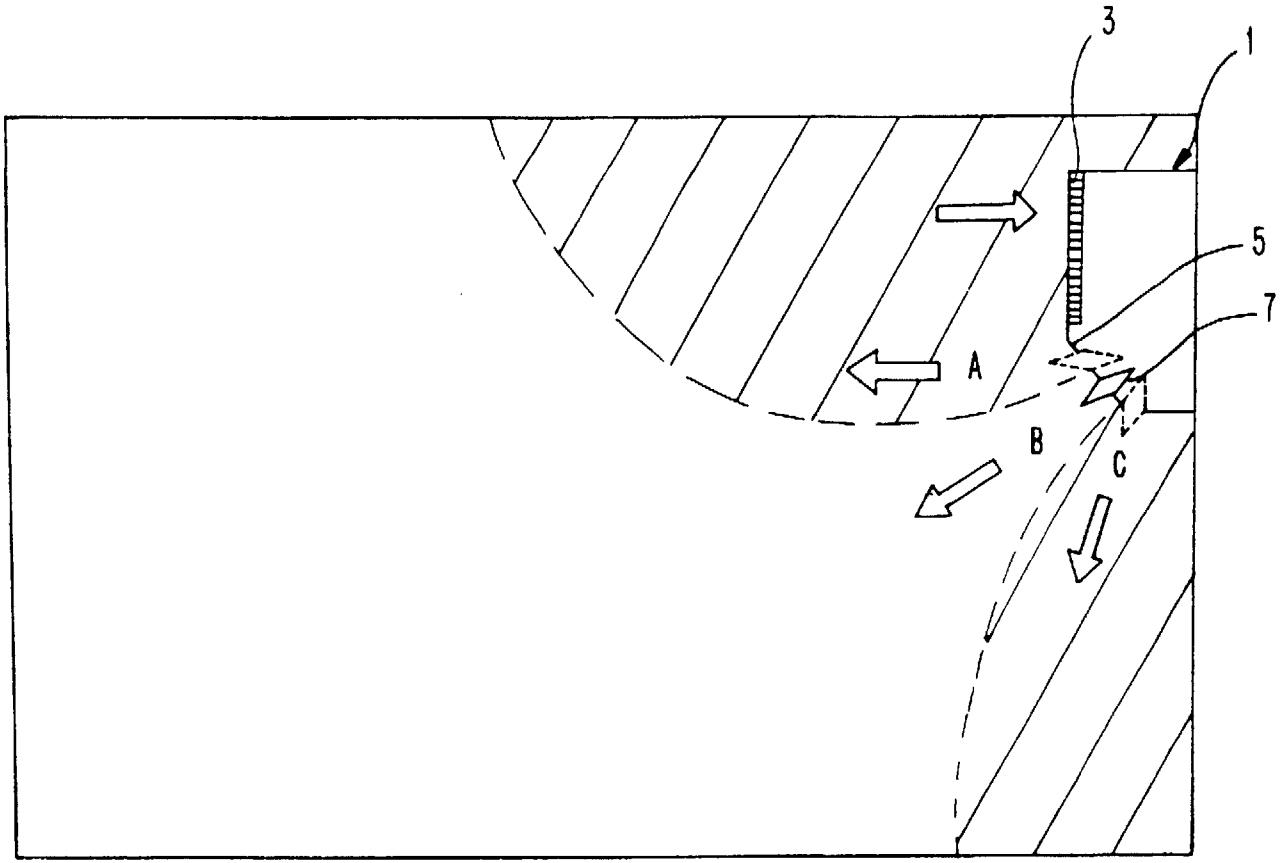
FIG. 3 (PRIOR ART)
FIG. 3 is a view for illustrating the distribution state of air present in a room in accordance with the prior art.
Figure 4:
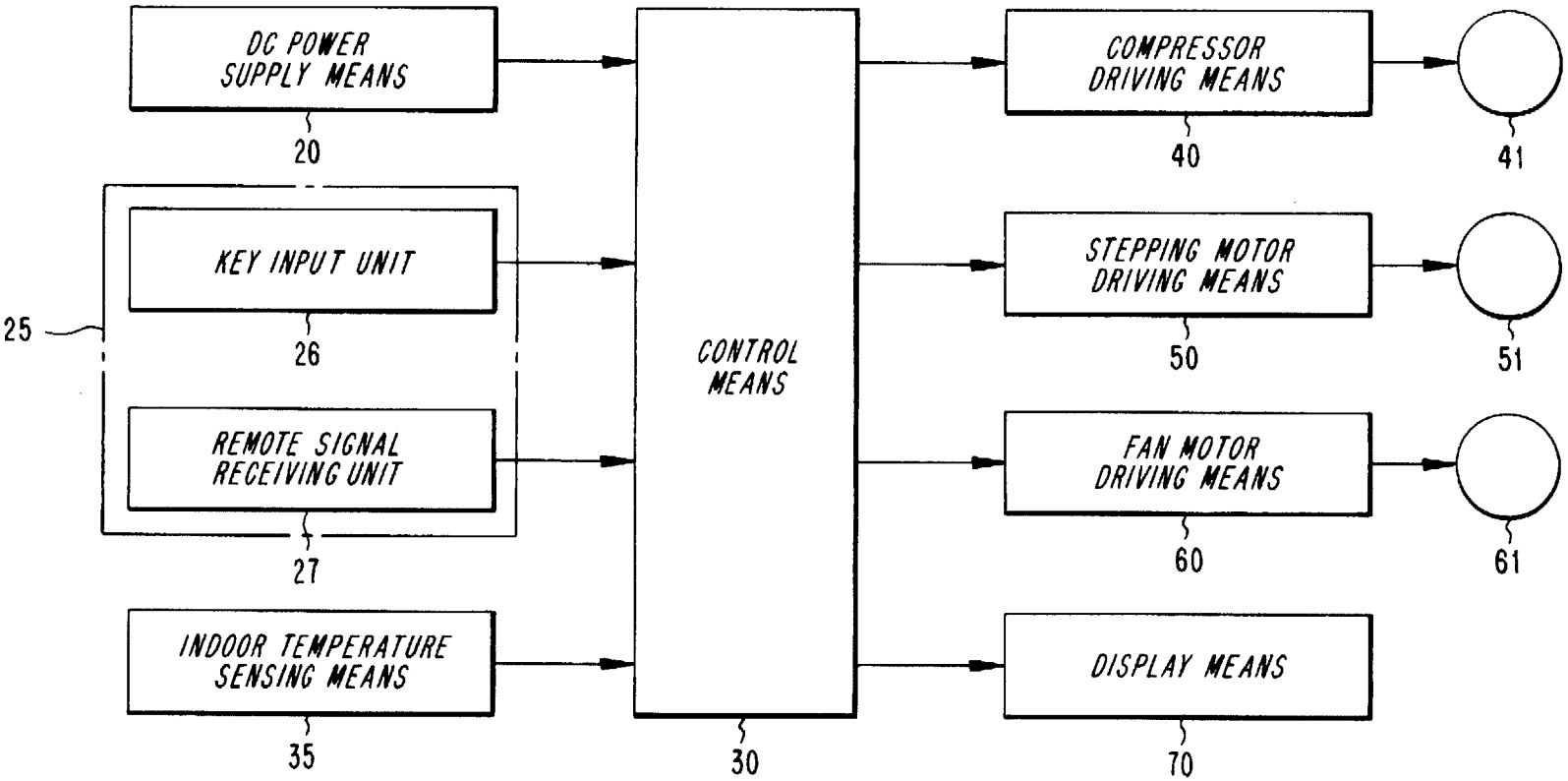
FIG. 4 is a block diagram illustrating a control system for a louver driving device of an air conditioner in accordance with the present invention.

FIG. 4 is a block diagram illustrating a control system for a louver driving device of an air conditioner in accordance with the present invention.

In FIG. 4, the louver driving control device includes a DC power supply means 20 for converting a commercial AC power source, input at an AC power input stage (not shown), into a DC voltage with a voltage level required to drive the air conditioner.

The louver driving control device also includes drive selection means 25 having a key input unit 26 and a remote signal receiving unit 27 for converting a user's control command into a corresponding signal to be outputted to control means (described later).

The user pushes down a plurality of keys provided in the drive selection means 25 to establish an operation mode (automatic, cooling, dehumidifying, heating, ventilation and the like), an operation start signal and an operation stop signal of the air conditioner.

The remote signal receiving unit 27 serves to receive an infra-red signal from a remote controller not shown.

All signals from the DC power supply means 10 and the drive selection means 25 are inputted to control means 30

The control means 30 is adapted to initiate the air conditioner upon receiving the DC voltage from the DC power supply means 10 and to control an overall operation of the air conditioner according to the user's control commands inputted from the drive selection means 25.

The control means 30 outputs a control signal for variably controlling the driving speed of the louver 7.

This control means 30 is a microcomputer.

Indoor temperature sensing means 35 serves to control the room temperature Tr to cause the same to become a temperature Ts established by the user via the drive selection means 25.

Compressor driving means 40 serves to receive from the control means 30 a control signal, which is generated according to a difference between temperature Ts established by the user via the drive selection means 25 and the room temperature Tr sensed by the indoor temperature sensing means 35, thereby driving a compressor 41.

Stepping motor driving means 50 serves to drive a stepping motor 51 in accordance with a control signal from the control means 30.

The control signal is generated from the control means 30 to adjust the direction of air being discharged through the air outlet 5 according to a wind direction established by the user, and, at the same time to variably control the driving speed of the louver 7 in the vertical direction depending on wether to the cooling mode is being performed or the heating mode.

Fan motor driving means 60 receives a control signal generated from the control means 30, thereby discharging heat-exchanged air (cold air or hot air) according to the amount of wind established by the user via the drive selection means 25.

In accordance with the control signal the fan motor driving means 60 controls the speed of a indoor fan motor 61 rotating the indoor fan 11.

Display means 70 serves not only to display an operation selection mode (automatic, cooling, heating, dehumidifying, ventilation and the like), temperatures Ts and Tr but also to display an operation state of the air conditioner.

Now, the louver driving operation in accordance with the embodiment of the present invention will be described in detail, in conjunction with FIGS. 4 to 9.

First, patterns of the driving speed of the louver in the vertical direction will be described in detail, in conjunction with FIGS. 5 and 6.

Figure 5:
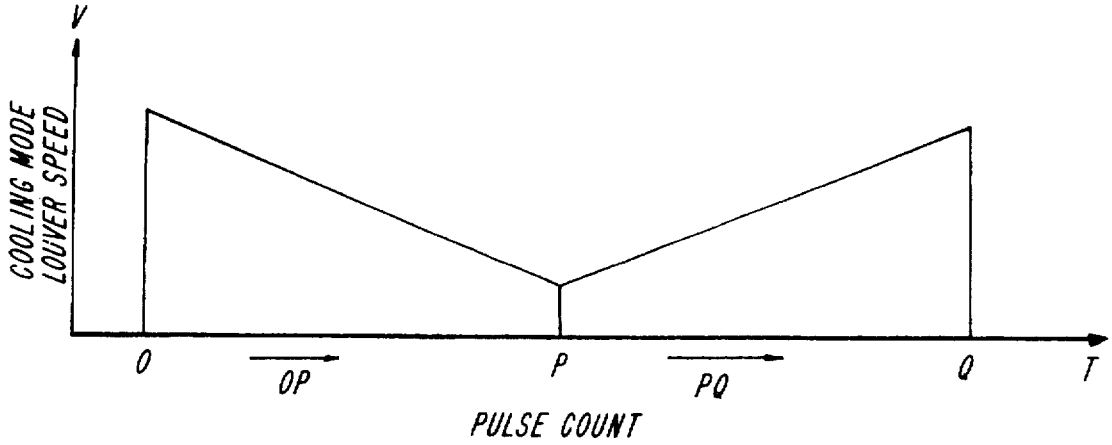
FIG. 5 is a view for illustrating the driving speed of the louver in cooling mode in accordance with the present invention.

FIG. 5 is a view for illustrating the driving speed of the louver 7 in the cooling mode.

When the louver 7 is at an initial point "O" which means an original bottom point, the control means 30 outputs a control signal having a predetermined long-period pulse to the stepping motor driving means 50 to drive the stepping motor 51.

In accordance with the control signal from the control means 30 the stepping motor driving means 50 drives the stepping motor 51, so that the louver 7 is driven in the upper direction from the initial point "O" as shown by arrow "OP". At this time, the driving speed of the louver 7 is linearly decreased.

While the louver 7 is driven in the upward direction, it is determined that the louver 7 is at a top point "P" by means of the number of pulses.

When the louver 7 is determined as being positioned at the point "P" the control means 30 outputs a control signal having a predetermined short-period pulse to the stepping motor driving means 50 to drive the stepping motor 51.

In accordance with the control signal from the control means 30 the stepping motor driving means 50 drives the stepping motor 51. Therefore, the louver 7 is driven in the lower direction from the point "P" as shown by arrow direction "PQ". At this time, the driving speed of the louver 7 is linearly increased.

While the louver 7 is driven in the downward direction, it is determined that the louver 7 is at a point "Q" by means of the number of pulses. When the louver 7 is determined as being positioned at the point "Q" the control means 30 outputs a control signal having a predetermined long-period pulse to the stepping motor driving means 50 to drive the stepping motor 51.

In accordance with the control signal from the control means 30 the stepping motor driving means 50 drives the stepping motor 51. Therefore, the louver 7 is driven in the upward direction at a linearly decreasing speed.

As is apparent from the foregoing description the louver 7 is continuously driven in the vertical direction to adjust the wind direction at a constantly varying speed of cool air being discharged through the air outlet 5.

Figure 6:
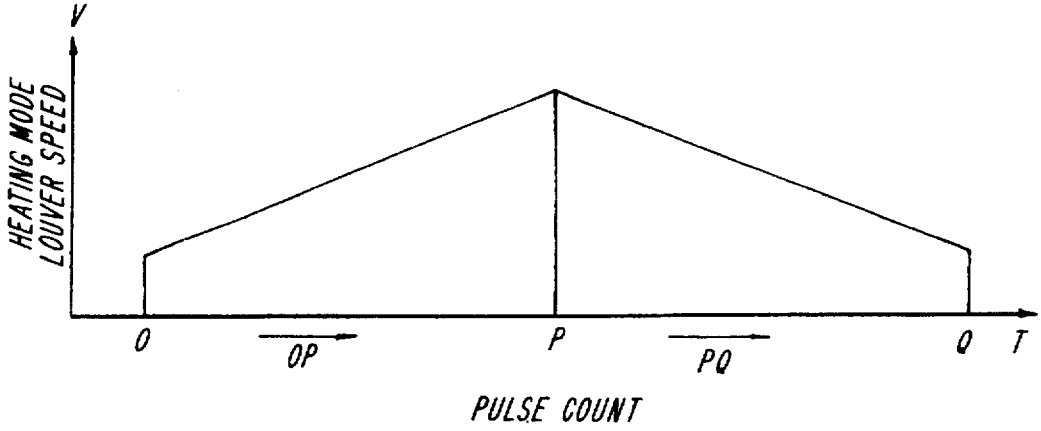
FIG. 6 is a view for illustrating the driving speed of the louver in heating mode in accordance with the present invention.

FIG. 6 is a view for illustrating the driving speed of the louver 7 in the heating mode.

When the louver 7 is at the initial point "O", the control means 30 outputs a control signal having a predetermined short-period pulse to the stepping motor driving means 50 to drive the stepping motor 51.

In accordance with the control signal from the control means 30 the stepping motor driving means 50 drives the stepping motor so that the louver 7 is driven in the upward direction from the initial point "O" as shown by arrow "OP". At this time, the driving speed of the louver 7 is linearly increased.

While the louver 7 is driven in the upward direction, it is determined that the louver 7 is at a point "P" by means of the number of pulses.

When the louver 7 is determined as being positioned at the point "P" the control means 30 outputs a control signal having a predetermined long-period pulse to the stepping motor driving means 50 to drive the stepping motor 51.

In accordance with the control signal from the control means 30 the stepping motor driving means 50 drives the stepping motor 51. Therefore, the louver 7 is driven in the downward direction from the point "P" as shown in arrow direction "PQ". At this time, the driving speed of the louver 7 is linearly decreased.

While the louver 7 is driven in the downward direction, it is determined that the louver 7 is at a point "Q" by means of the number of pulses. When the louver 7 is determined as being positioned at the point "Q" the control means 30 outputs a control signal having a predetermined short-period pulse to the stepping motor driving means 50 to drive the stepping motor 51.

In accordance with the control signal from the control means 30 the stepping motor driving means 50 drives the stepping motor 51. Therefore, the louver 7 is driven in the upward direction at a linearly increasing speed.

As is apparent from the foregoing description the louver 7 is continuously driven in the vertical direction at a constantly varying speed to adjust the wind direction of air being discharged through the air outlet 5.

Figure 7A:
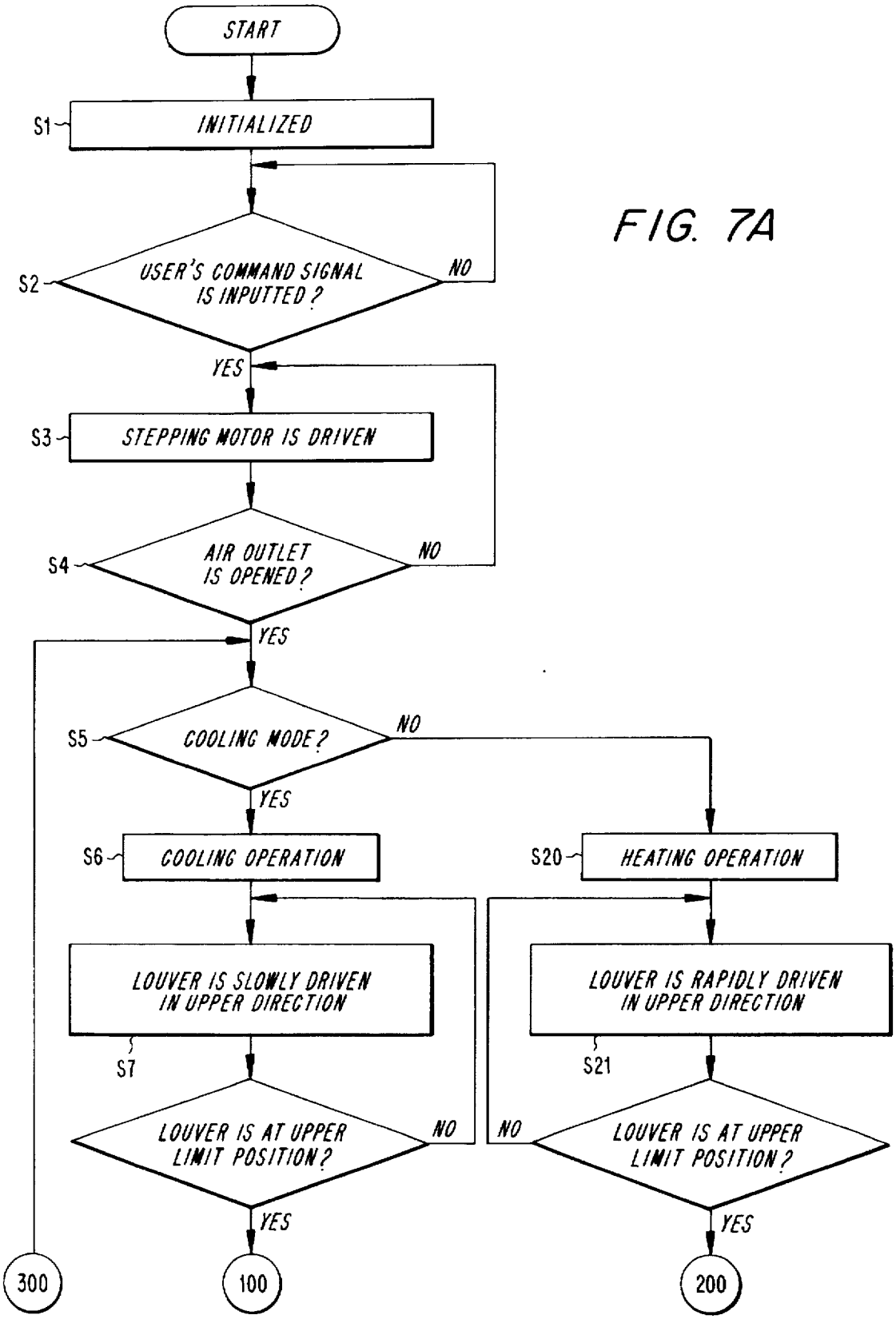
FIGS. 7A and 7B are flow charts illustrating a method of driving the wind direction louver in accordance with the present invention.
Figure 7B:
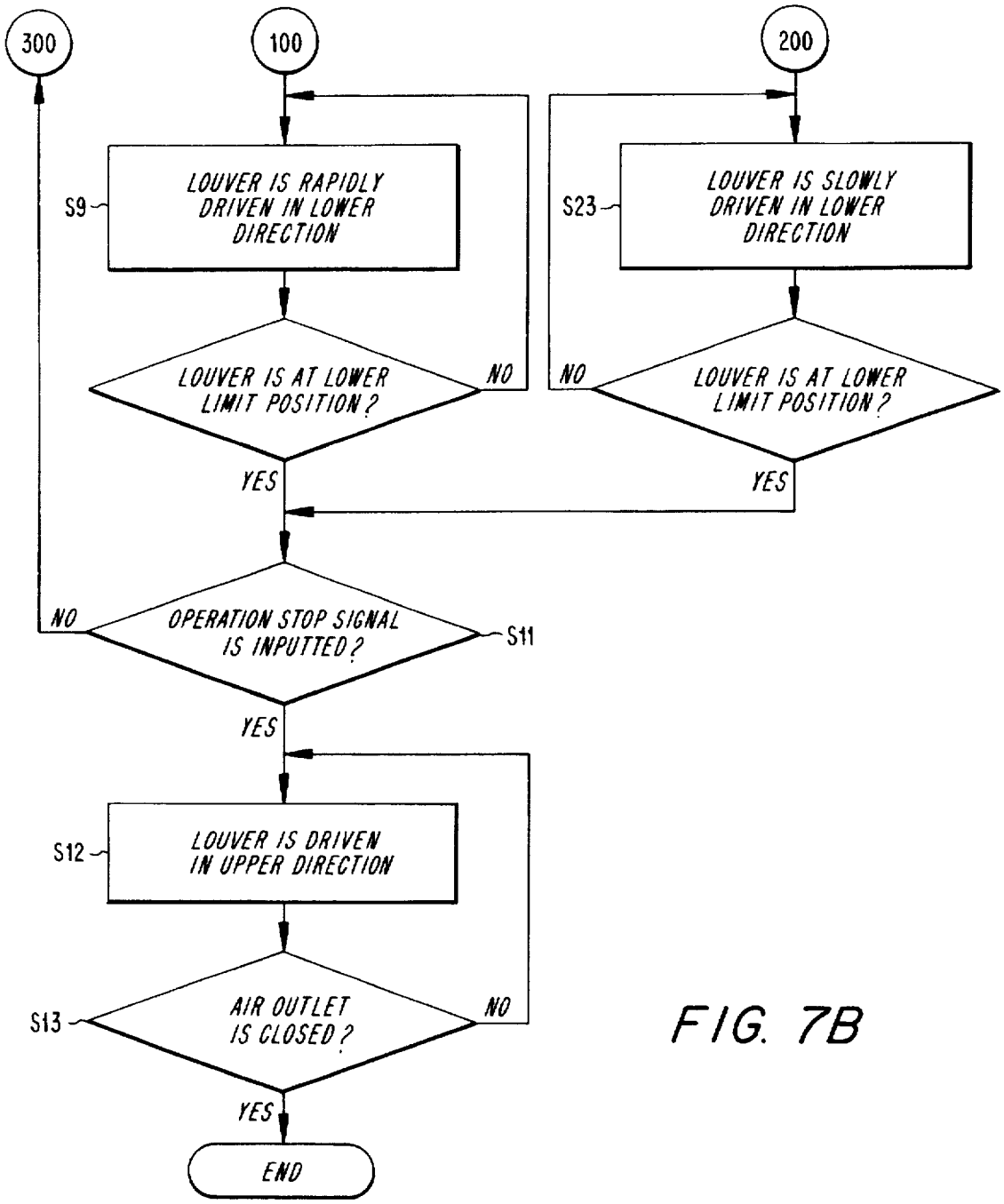

FIGS. 7A and 7B are flow charts illustrating a method of driving the wind direction louver in accordance with the present invention.

Once the air conditioner is powered, the DC power supply means 20 converts a source voltage received from a commercial AC power source at its AC power input stage (not shown) into a DC voltage with a voltage level required to drive the air condition.

The DC voltage from the DC power supply means 20 is then applied to the control means 30 as well as to various driving circuits.

Upon receiving the DC voltage from the DC power supply means 20, the control means 30 initializes the air conditioner at step S1.

When the user manipulates the drive selection means 25 to operate the air conditioner, the control means 30 generates an appropriate drive signal on the basis of a signal outputted from the drive selection means 25.

It is then determined whether or not the user's command signal is inputted from the drive selection means 25 into the control means 30 at step S2.

As a result, when the user's command signal is not inputted (namely, if NO), the air condition maintains the standby state until the user's command signal is inputted.

On the other hand, when the user's command signal is inputted at step S2 (namely, if YES), the procedure proceeds to step S3.

At step S3, the control means 30 outputs a control signal to the stepping motor driving means 50 to drive the stepping motor 51.

In accordance with the control signal from the control means 30 the stepping motor driving means 50 drives the stepping motor 51 thereby driving the louver 7, coupled to the axis of the stepping motor 51, in the downward direction.

Subsequently, while the louver is driven in the downward direction the control means 30 determines whether or not the stepping motor 51 is driven for a predetermined time, that is a time necessary for completely opening the air outlet 5 at step S4.

As a result, when the air outlet 5 has not completely opened at step S4 (namely, if NO), the procedure returns to step S3 and repeatedly executes the procedure from step S3 until the stepping motor 51 is driven for the predetermined time.

On the other hand, when the air outlet 5 has been completely opened at step S4 (namely if YES), the control means 30 determines the present position of the louver as being the initial point for driving the louver 7 in the upward direction.

The above-described driving of the louver 7 is performed in order to locate the louver at a specific (initial) position. Thus, the movement of the louver can be accurately controlled.

When the louver 7 is at the initial point, step S5 is executed. At step S5, a determination is made about whether or not the operation mode inputted from the remote signal receiving unit 27 is the cooling mode.

When the cooling mode has been selected at step S5(namely, if YES) the procedure proceeds to step S6.

At step S6 the control means 30 generates a control signal for driving the indoor fan 11 and sends it to the fan motor driving means 60.

In response to the received control signal, the fan motor driving means 60 rotates the fan motor 61 and thereby the fan 11.

As the fan 11 is driven, air in the room is introduced into the interior of the body 1 through the air inlet 3 and is then subjected to a heat exchange by the heat exchanger 9 so that it may be cooled. The cooled air is then continuously discharged through the air outlet 5 by the fan 11 to be introduced into the room again.

At a subsequent step S7, the control means 30 generates a control signal having the predetermined long-period pulse for driving the stepping motor 51 and sends it to the stepping motor driving means 50.

In response to the received control signal the stepping motor driving means 50 rotates the stepping motor 51 at a speed which is linearly decreased as shown in FIG. 5 so that the louver is driven in the upward direction at a decreasing speed.

As the louver 7 is driven in the upper direction, a relatively large amount of cooled air is discharged to the upper portion of the room through the air outlet 5 since the louver speed is constantly being reduced.

Therefore, the cooled air being discharged to the upper portion of the room is circulated in the room, thereby causing the room to be uniformly cooled.

Simultaneously with the driving of the louver 7 in the upward direction, the control means 30 activates a counter (typically equipped in the control means 30).

Subsequently, a determination is made at step S8 about whether or not the louver 7 is at the upper limit position.

That is, the control means 30 determines whether or not the louver 7 has reached the upper limit position by counting the number of pulses being outputted to the stepping motor driving means 50.

The number of pulses for determining the upper limit position is previously stored in the control means 30.

As a result, when the louver 7 has not reached the upper limit position at step S8 (namely, if NO), the procedure returns to step S7 and repeatedly executes the procedure from step S7 until the louver 7 has reached the upper limit position.

On the other hand, when the louver 7 has reached the upper limit position at step S8 (namely, if YES), the procedure proceeds to step S9.

At step S9, the control means 30 generates a control signal having the predetermined short-period pulse for driving the stepping motor 51 and sends it to the stepping motor driving means 50.

In response to the received control signal the stepping motor driving means 50 rotates the stepping motor 51 as the driving speed is linearly increased as shown in FIG. 5 so that the louver 7 is driven in the downward direction at an increasing speed.

As the louver 7 is rapidly driven in the lower range of its movement, a relatively small amount of cooled air is discharged to the lower portion of the room.

Simultaneously with the driving of the louver 7 in the downward direction, the control means 30 activates the counter.

Subsequently, a determination is made at step S10 about whether or not the louver 7 is at the lower limit position.

That is, the control means 30 determines whether or not the louver 7 has reached the lower limit position by counting the number of pulses being outputted to the stepping motor driving means 50.

The number of pulses for determining the lower limit position is previously stored in the control means 30.

As a result, when the louver 7 has not reached the lower limit position at step S10 (namely, if NO), the procedure returns to step S9 and repeatedly executes the procedure from step S9 until the louver 7 has reached the lower limit position.

On the other hand, when the louver 7 has reached the lower limit position at step S10 (namely, if YES), the procedure proceeds to step S11.

At step S11, it is determined whether or not the operation stop signal is inputted via the key input unit 26 or remote signal receiving unit 27. If the operation stop signal has been determined at step S11 as being not inputted (namely, if NO), the procedure proceeds to step S5 and repeatedly executes the procedure from step S5, thereby continuously driving the louver 7 in the vertical direction as in the foregoing description.

Figure 8:
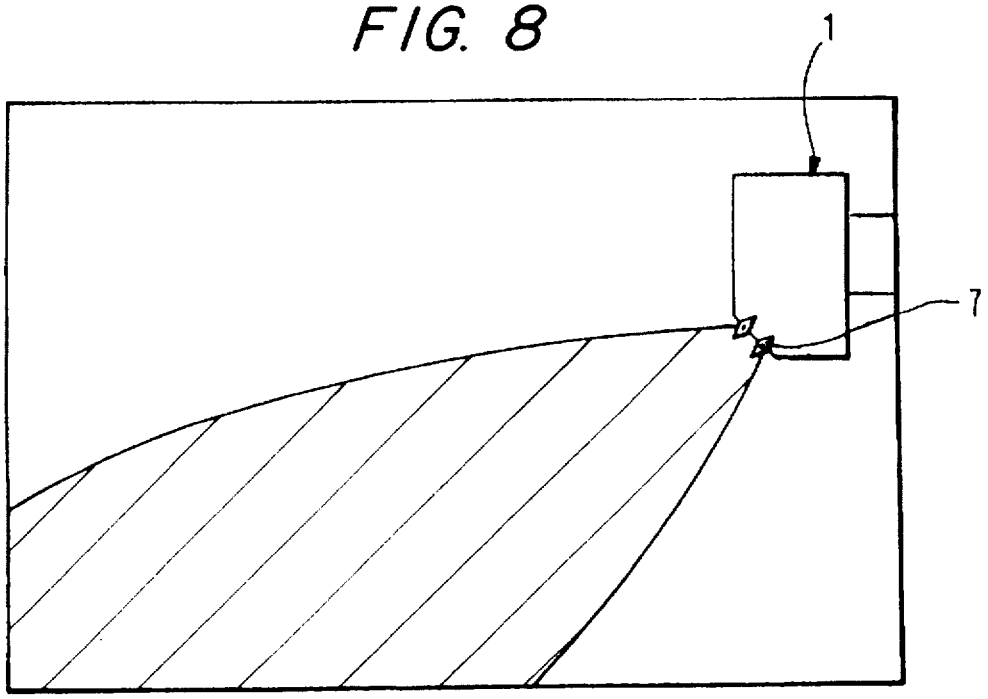
FIG. 8 is a view for illustrating the distribution state of air present in a room in the cooling mode of the present invention.

As shown in FIG. 8 a relatively uniform temperature in the room is constantly maintained since much of the cooled air being discharged is delivered to an upper portion of the room.

On the other hand, when the operation stop signal has been determined at step S11 as being inputted (namely, if YES), the procedure proceeds to step S12.

At step S12, the control means 30 generates a control signal for driving the stepping motor 51 and sends it to the stepping motor driving means 50.

In response to the received control signal from the control means 30 the stepping motor driving means 50 drives the stepping motor 51, thereby causing the louver 7 to be driven in the upward direction.

Simultaneously with the driving of the louver 7 in the upper direction at step S12, the control means 30 activates a timer (typically equipped in the control means 30).

Subsequently, a determination is made at step S13 about whether or not the stepping motor 51 is driven for a predetermined time, that is time necessary for completely closing the air outlet 5.

As a result, when the air outlet 5 has not been closed at step S13 (namely, if NO), the procedure returns to step S12 and repeatedly executes the procedure from step S12 until the air outlet 5 is completely closed.

On the other hand, when the air outlet 5 has been completely closed at step S13 (namely, if YES), the control means 30 generates a control signal for stopping the stepping motor 51 and sends it to the stepping motor driving means 50.

In response to the received control signal from the control means 30 the stepping motor driving means 50 cuts off the source voltage being applied to the stepping motor 51, thereby stopping the stepping motor 51.

In the stopped state of the stepping motor 51, the louver 7 is also stopped.

Thus, the air conditioning operation is completed.

Meanwhile, when the cooling mode has been not selected at step S5 (namely , if NO), the procedure proceeds to step S20 to perform a heating operation.

At step S20, the control means 30 generates a control signal for rotating the fan 11 according to the amount of wind established by the drive selection means 25 and sends it to the fan motor driving means 60.

As the fan 11 is driven, air in the room is introduced into the interior in body 1 through the air inlet 3 and is then subjected to a heat exchange by the heat exchanger 9 so that it may be heated. The heated air is then continuously discharged through the air outlet 5 by the fan 11 to be introduced into the room again.

At a subsequent step S21, the control means 30 generates a control signal corresponding to the predetermined short-period pulse for driving the stepping motor 51 and sends it to the stepping motor driving means 50.

In response to the received control signal from the control means 30 the stepping motor driving means 50 rotates the stepping motor 51 and the driving speed is linearly increased as shown in FIG. 6 so that the louver 7 is driven in the upward direction at an increasing.

As the louver 7 is rapidly driven in the upper range of its movement, a relatively small amount of heated air is discharged to the upper portion of the room through the air outlet 5.

Simultaneously with the driving of the louver 7 in the upward direction, the control means 30 activates the counter. Subsequently, a determination is made at step S22 about whether or not the louver 7 is at the upper limit position.

That is, the control means 30 determines whether or not the louver 7 has reached the upper limit position by counting the number of pulses being outputted to the stepping motor driving means 50.

As a result, when the louver 7 has not reached the upper limit position at step S22 (namely, if NO), the procedure returns to step S21 and repeatedly executes the procedure from step S21 until the louver 7 has reached the upper limit position.

On the other hand, when the louver 7 has reached the upper limit position at step S22 (namely, if YES), the procedure proceeds to step S23.

At step S23, the control means 30 generates a control signal having the predetermined long-period pulse for driving the stepping motor 51 and sends it to the stepping motor driving means 50.

In response to the received control signal the stepping motor driving means 50 rotates the stepping motor 51 as the driving speed is linearly decreased as shown in FIG. 6 so that the louver 7 is driven in the downward direction at a decreasing speed.

As the louver 7 is slowly driven in the lower range of its movement, a relatively large amount of heated air is discharged to the lower portion of the room.

Therefore, the heated air being discharged to the lower portion of the room is circulated in the room, thereby causing the room to be uniformly heated.

Simultaneously with the driving of the louver 7 in the upward direction, the control means 30 activates the counter.

Subsequently, a determination is made at step S24 about whether or not the louver 7 is at the lower limit position.

As a result, when the louver 7 has not reached the lower limit position at step S24 (namely, if NO), the procedure returns to step S23 and repeatedly executes the procedure from step S23 until the louver 7 has reached the lower limit position.

Figure 9:
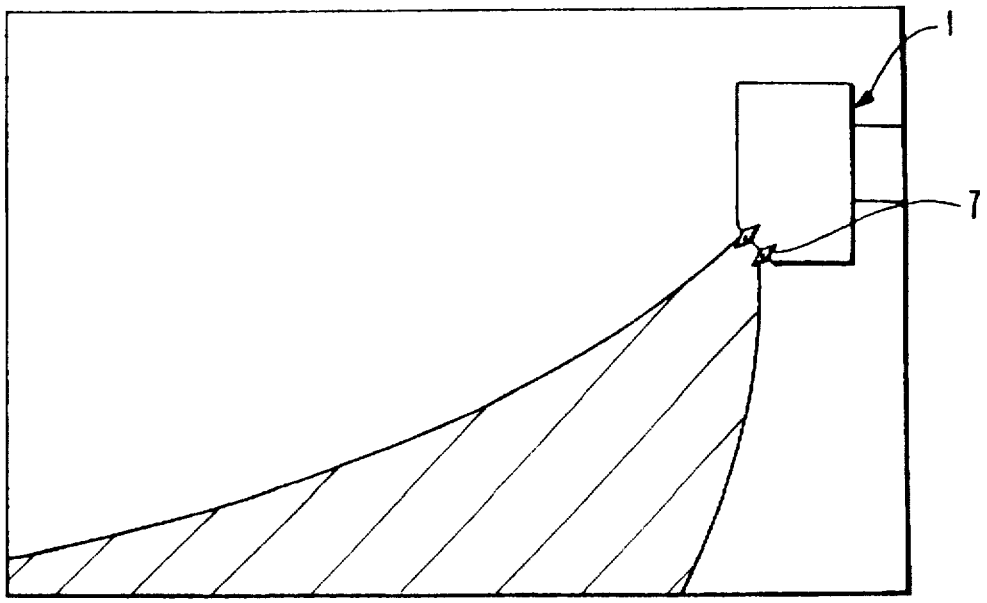
FIG. 9 is a view for illustrating the distribution state of air present in a room in the heating mode of the present invention.

Therefor a relatively uniform temperature in the room is constantly maintained much of the heated air being discharged is delivered to the lower portion of the room as shown in FIG. 9.

On the other hand, when the louver 7 has reached the lower limit position at step S24 (namely, if YES), the procedure proceeds to step S11 and executes the procedure from step S11.

Having described a specific preferred embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. A room air conditioner, comprising:

a body having an air inlet and an air outlet;

a heat exchanger in the body;

a fan for drawing room air through the air inlet and discharging the air back into the room after passing the air through the heat exchanger;

an air directing louver at the air outlet for controlling a direction of flow of the discharged air, the air directing louver being vertically adjustable to adjust the discharged air flow direction upwardly and downwardly;

a motor connected to the louver for vertically adjusting the louver;

a manual selector for enabling a user to select between heating and cooling modes of operation; and a controller operably connected to the manual selector and the motor for operating the motor in a first mode during a cooling mode of operation, and in a second mode different from the first mode, during a heating mode of operation.

2. The air conditioner according to claim 1 wherein the first mode constitutes a first speed pattern for louver adjustment, and the second mode constitutes a second speed pattern for louver adjustment which is different from the first speed pattern.

3. The air conditioner according to claim 2 wherein the first speed pattern includes vertically adjusting the louver such that a speed of travel of the louver is faster in a lower range of its movement than in an upper range of its movement; and the second speed pattern includes vertically adjusting the louver such that a speed of travel of the louver is faster when the louver is at an upper range of its movement than at a lower range of its movement.

4. The air conditioner according to claim 1 wherein the motor is driven by driving pulses received from the controller, the controller including a counter for counting the driving pulses to determine a position of adjustment of the louver.

5. The air conditioner according to claim 4 wherein the motor is a stepping motor.

6. A method of operating a room air conditioner, the air conditioner having a body with an air inlet and an air outlet, a heat exchanger in the body, a fan for drawing-in room air through the air inlet and discharging the air back into the room after passing the air through the heat exchanger, an air directing louver at the air outlet for controlling a direction of flow of the discharged air, the louver being vertically adjustable to adjust the discharged air flow direction upwardly and downwardly, and a motor connected to the louver for vertically adjusting the louver, the method comprising the steps of operating the motor in a first mode during a cooling mode of operation, and in a second mode different from the first mode, during a heating mode of operation.

7. The method according to claim 6 wherein the step of operating the motor in the first mode comprises operating the motor such that a speed of travel of the louver is faster in a lower range of its movement than in an upper range of its movement; and the step of operating the motor in the second mode comprises operating the motor such that a speed of travel of the louver is faster in an upper range of its movement than in a lower range of its movement.

8. The method according to claim 7 further including the step of moving the louver to an initial point prior to operating the motor in either of the first and second modes.

* * * * *